US006779467B1

(12) United States Patent
McCoy et al.

(10) Patent No.: US 6,779,467 B1
(45) Date of Patent: Aug. 24, 2004

(54) HIDE AWAY DESK

(76) Inventors: Laquetta A. McCoy, HC76 Box 578, Eagletown, OK (US) 74734; Marvin Dale McCoy, HC76 Box 578, Eagletown, OK (US) 74734

( * ) Notice: Subject to any disclaimer, the term of this patent is extended or adjusted under 35 U.S.C. 154(b) by 0 days.

(21) Appl. No.: 10/286,123

(22) Filed: Nov. 1, 2002

(51) Int. Cl.[7] ..... A47B 37/00
(52) U.S. Cl. ..... 108/42; 108/134
(58) Field of Search ..... 211/88.01, 90.01, 211/90.02, 104, 119.003, 119.005, 126.5; 248/240, 242, 455, 456, 188.2; 108/42, 134, 135, 152

(56) References Cited

U.S. PATENT DOCUMENTS

| | | | | | |
|---|---|---|---|---|---|
| 523,355 | A | * | 7/1894 | Kinley et al | 108/135 |
| 970,777 | A | * | 9/1910 | Ackerman | 248/240.4 |
| 1,034,021 | A | * | 7/1912 | Mendenhall et al | 108/93 |
| 1,228,042 | A | * | 5/1917 | ODowd | 126/190 |
| 1,852,723 | A | * | 4/1932 | Orton et al | 108/134 |
| 2,461,684 | A | | 2/1949 | Diericky | |
| 4,592,603 | A | | 6/1986 | Adams et al. | |
| 4,789,123 | A | * | 12/1988 | Mattsson | 248/240.4 |
| 4,909,423 | A | * | 3/1990 | Isak | 224/483 |
| D357,599 | S | | 4/1995 | Kelley | |
| D376,491 | S | | 12/1996 | Kelley | |
| D376,496 | S | | 12/1996 | Kelley et al. | |
| 5,678,905 | A | | 10/1997 | Kelley | |
| 5,778,573 | A | * | 7/1998 | Nottingham et al. | 38/103 |
| 5,913,769 | A | | 6/1999 | Byma et al. | |
| 5,927,833 | A | | 7/1999 | Kelley | |
| 6,412,423 | B1 | * | 7/2002 | Elizondo, Jr. | 108/35 |
| 6,543,733 | B1 | * | 4/2003 | Pennington | 248/149 |

* cited by examiner

*Primary Examiner*—Janet M. Wilkens
(74) *Attorney, Agent, or Firm*—John D. Gugliotta; Olen L. York, III; P. Jeff Martin

(57) ABSTRACT

A desk is designed for mounting to a wall or for mounting to either side of a door. The desk consists of a table surface attached via a hinge mechanism to the wall or door. When folded down into its utilized state, there is a leg support, with integral springs that supports the desk surface to the floor, wall or door. Additionally, a swing arm support supports the rear of the desk surface from the wall as well. Additional swing down components such as shelves, paper holders, and even a desk chair are also envisioned. All supporting hardware is of high-strength design and is locking for sure support. Any surfaces which may touch finished surfaces are provided with rubber bumpers for protection. The use of the desk allows those with limited floor space, or those who do not want the appearance of a permanent desk, to have a useful and functional desk to perform various activities that require a flat, horizontal surface almost anywhere in a home.

6 Claims, 4 Drawing Sheets

HIDE AWAY DESK

RELATED APPLICATIONS

The present invention was first described in Disclosure Document Registration 501,959 filed on Dec. 7, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to a collapsible desk surface, more particularly, to such a collapsible desk surface affixed to a wall or other structure so as to allow the desk surface to fold out for use or fold up for storage.

2. Description of the Related Art

The usefulness of a desk is not just limited to office environments. Desks often find use in homes for paying bills, doing taxes, completing homework assignments, working on craft projects and the like. However, the space for a desk is limited in many homes and is even more difficult to find in apartments and dorm rooms. While folding tables and portable desks do exist, they require time to set up and strike down. And when collapsed, they still require space to store. Additionally, their portable nature often means flimsiness which limits the amount of material that can be placed upon them. Finally, a portable table does not provide a place to store objects on shelves, or a place to sit, both of which are common on a conventional desk. Accordingly, there is a need for a means by which the convenience and functionality of a desk can be provided in those areas which are space limited.

The present invention is aimed at an improved collapsible desk surface by offering a relatively inexpensive system for home or office use requiring far less space. The present invention is a flat surface for use as a desk surface. Along the bottom of the desk surface is a bracing mechanism which supports the horizontally positioned desk surface. The bracing mechanism also includes a bar that provides support to the desk surface when it is folded vertically for storage. The present invention also includes a swinging member which houses pockets for storing miscellaneous desk items. The swinging member moves toward the structure supporting the desk surface and is secured against the support structure when the desk surface is vertically raised and collapsed against the swinging member.

A search of the prior art did not disclose any patents that read directly on the claims of the instant invention; however, the following references were considered related:

U.S. Pat. No. 5,927,833 issued in the name of Kelley, describes a concealed desk.

U.S. Pat. No. 5,913,769 issued in the name of Byma et al., describes a combination desk and fold-out bed.

U.S. Pat. No. 5,678,905 issued in the name of Kelley, describes a concealed desk.

U.S. Pat. No. 4,592,603 issued in the name of Adams, describes a server/desk with a top that separates revealing a cavity in the back to hold an extra leaf for a dining room table.

U.S. Pat. No. 2,461,684 issued in the name of Dierickx, describes an ornamental desk and full size table combination.

U.S. Pat. No. D376,496 issued in the name of Kelley et al., describes an ornamental design for a computer workplace. U.S. Pat. No. D376,491 issued in the name of Kelley, describes an ornamental design for a computer secretary.

U.S. Pat. No. D357,599 issued in the name of Kelley, describes an ornamental design for a computer workstation.

Consequently, there exists a continuous need for new product ideas and enhancements for existing products in the collapsible desk industry.

SUMMARY OF THE INVENTION

It is therefore an object of the present invention to provide a collapsible desk.

It is a feature of the present invention to provide a collapsible desk apparatus that combines inexpensive and long-lasting components completely integrated to provide a convenient means for maximizing work space and maintaining a tidy office environment.

It is a further feature of the present invention to provide a collapsible desk apparatus that includes a bracing arm and a plate that maintains the structural integrity of the desk as it is moved from a vertical position to a horizontal position.

Briefly described according to one embodiment of the present invention, a desk is designed for mounting to a wall or for mounting to either side of a door. The desk consists of a table surface attached via a hinge mechanism to the wall or door. When folded down into its utilized state, there is a leg support, with integral springs that supports the desk surface to the floor, wall or door. Additionally, a swing arm support supports the rear of the desk surface from the wall as well. Additional swing down components such as shelves, paper holders, and even a desk chair are also envisioned. All supporting hardware is of high-strength design and is locking for sure support. Any surfaces which may touch finished surfaces are provided with rubber bumpers for protection. The use of the desk allows those with limited floor space, or those who do not want the appearance of a permanent desk, to have a useful and functional desk to perform various activities that require a flat, horizontal surface almost anywhere in a home.

The use of the present invention provides users with all of the materials and tools necessary to ensure that a user may easily install, use and maintain a collapsible desk.

An advantage of the present invention is that it is specifically adapted for personal use because of the light weight components and the use of inexpensive materials.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 3-B is a plan view of the bottom surface of the planar platform, in which the chamber, the track, the slidable tongue and the roller are shown, with the tongue shown in an opened position;

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
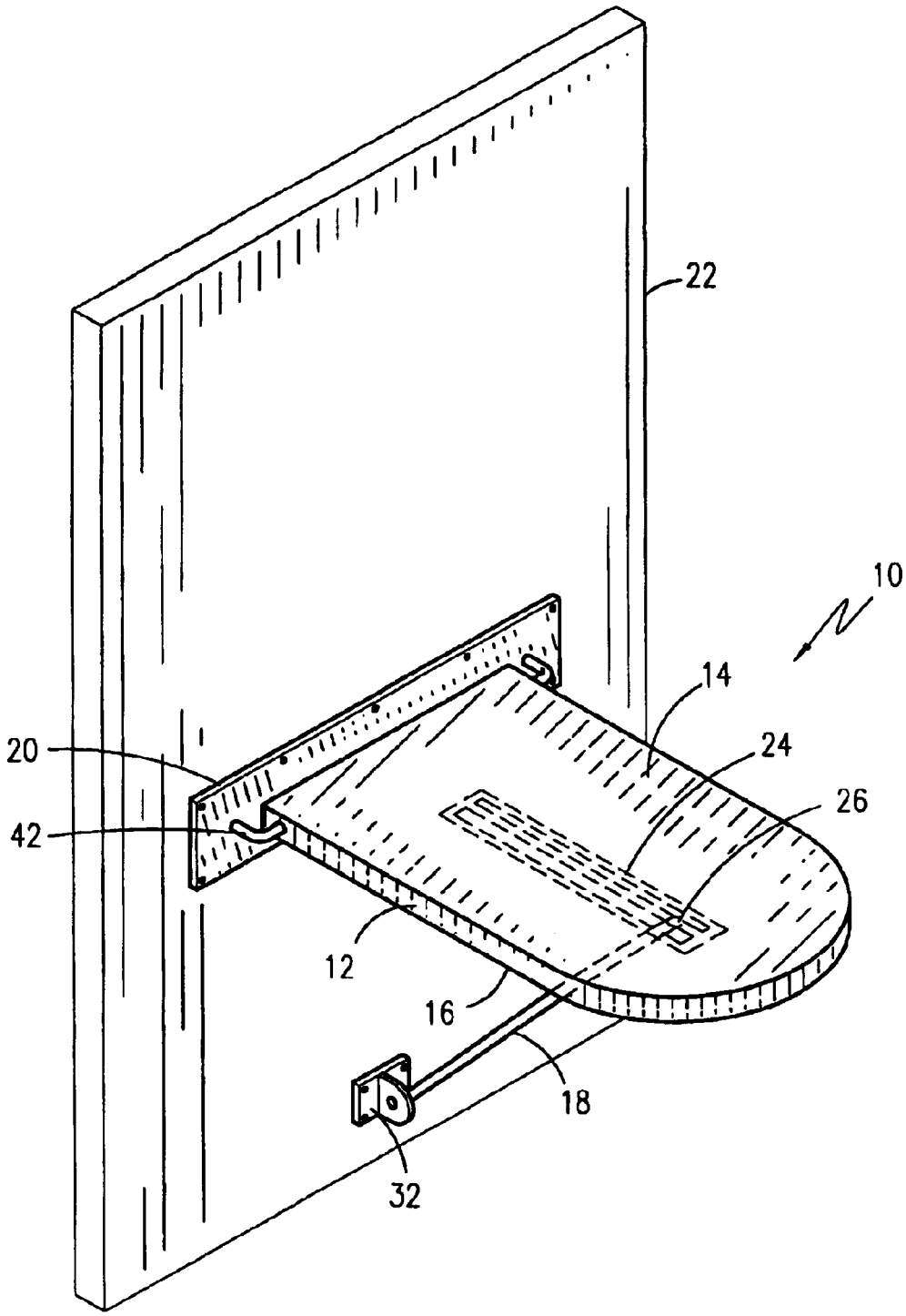
FIG. 1 is a perspective view of a collapsible desk attached to a door, shown in an open (horizontal) position.
Figure 2:
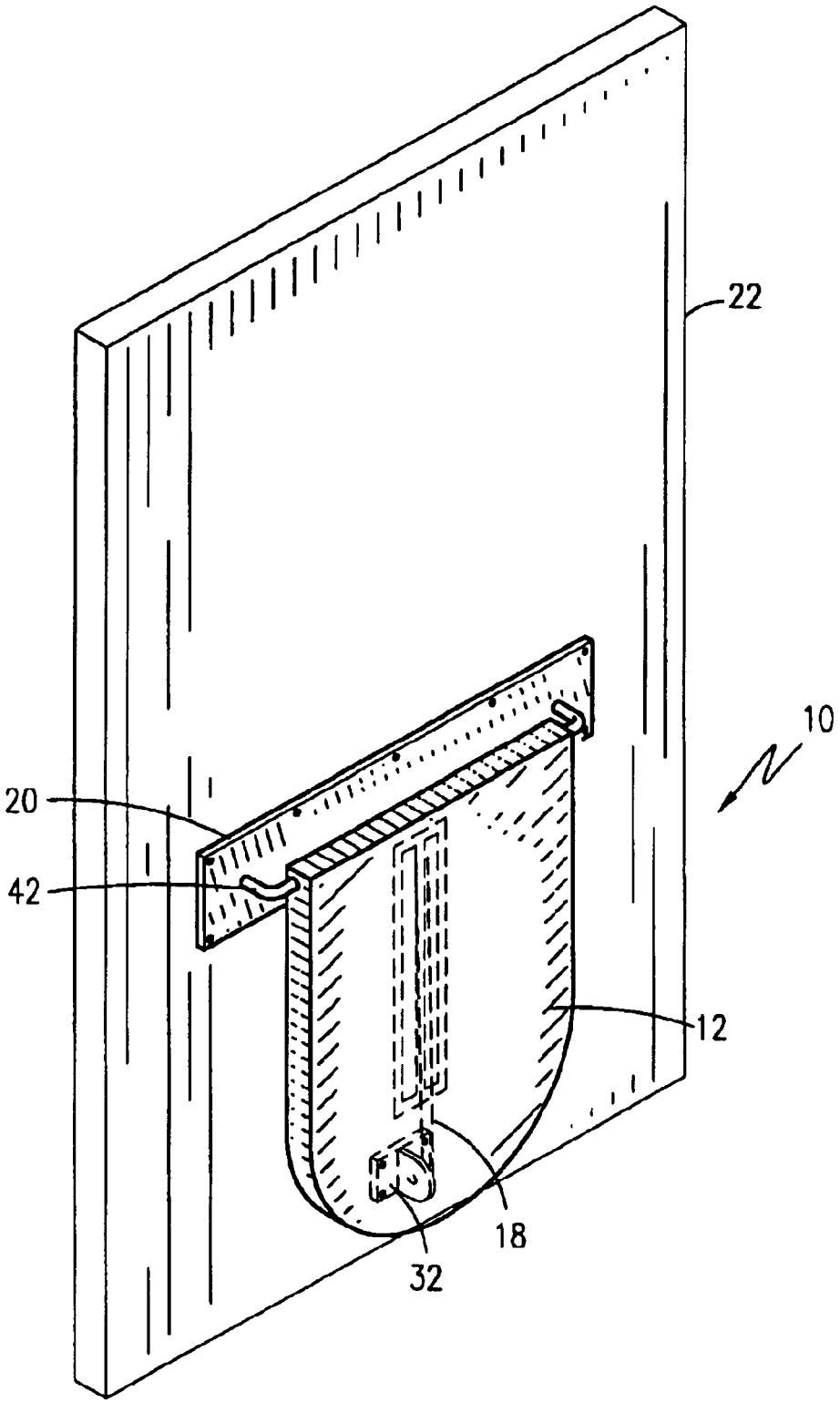
FIG. 2 is a perspective view of the collapsible desk of FIG. 1, in which the desk is shown in a closed (vertical) position.

Referring now to FIG. 1 and FIG. 2, a collapsible desk 10 is shown, according to the present invention, and includes a planar platform 12 with a top surface 14 for working on and a bottom surface 16 for receiving a spring biased bracing arm 18. Along one perimeter of the planar platform 12, the planar platform 12 is coupled to a brace plate 20, which allows for attachment of the collapsible desk 10 to a door 22 or other rigid supporting structure. Preferably, the planar platform 12 is manufactured from a durable and rigid material, such as wood, metal or plastic, so as to provide a rigid surface for performing desk work while withstanding repeated use and storage.

Figure 3A:
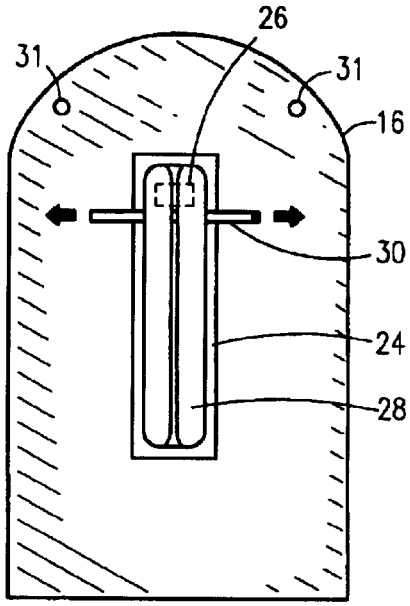
FIG. 3-A is a plan view of the bottom surface of the planar platform, in which the chamber, the track, the slidable tongue and the roller are shown, with the tongue shown in a closed (secured) position.
Figure 3B:
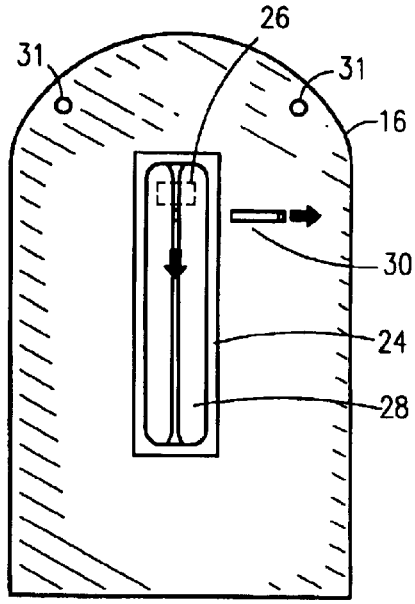

Referring to FIG. 1 through FIG. 3-B, the bottom surface 16 includes a rectangular chamber 24, positioned along a mid-line of the bottom surface 16 extending perpendicularly from the door 22, for receiving and housing a roller 26 of the spring biased bracing arm 18. The chamber 24 includes a track 28 which allows the roller 26 to smoothly travel along the chamber 24 as the planar platform 12 is extended and retracted. The track 28 includes a slidable tongue 30, positioned perpendicular to the direction of the track 28, which may be placed In a closed (as shown in FIG. 1) or open position (as implied in FIG. 2) position. In a closed position, the slidable tongue 30 acts to prevent the roller 26 from moving, due to the spring biased bracing arm 18, and thereby preventing the planar platform 12. In an open position, the slidable tongue 30 acts in allowing the roller 26 to move along the track 28, and thereby permitting the planar platform 12 to assume a vertical orientation for storage. A pair of protective bumpers 31 are positioned along the bottom surface 16 of the planar platform 12 so as to provide protection to the door 22 when the planar platform 12 is lowered into a vertical orientation for storage. The protective bumpers 31 may be of rubber, tipped with felt or another soft material, or any other item suitable for protecting a door 22 for dings or scratches.

Figure 4:
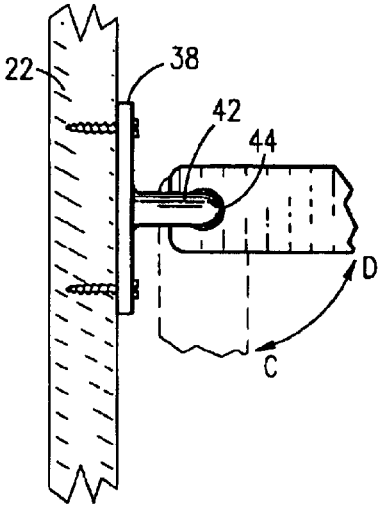
FIG. 4 is a side view of the door plate and bracing arm assembly, illustrating the hinged connection and the biased spring.

Referring now to FIG. 4, the spring biased bracing arm 18 includes a linearly elongated member 34 surrounding a biased spring 36 and is fixedly attached to a door plate 32 at a lower end by a hinge 48, which allows the bracing arm 18 to move along the lines A-B and B-A for use or storage of the collapsible desk 10. The door plate 32 is fixedly attached to the base of the door 22 (and adjacent to the floor 46) by a plurality of attachment means, such as a screw. The door plate 32 acts to support the expansion and contraction of the bracing arm 18. At an upper end, the bracing arm 18 includes a roller 26 for allowing the bracing arm 18 to sufficiently support the planar platform 12 in either a closed or open position. Preferably, the roller 26 is manufactured from a durable plastic so as to withstand repeated use as the roller 26 rolls through the track 28.

Figure 5:
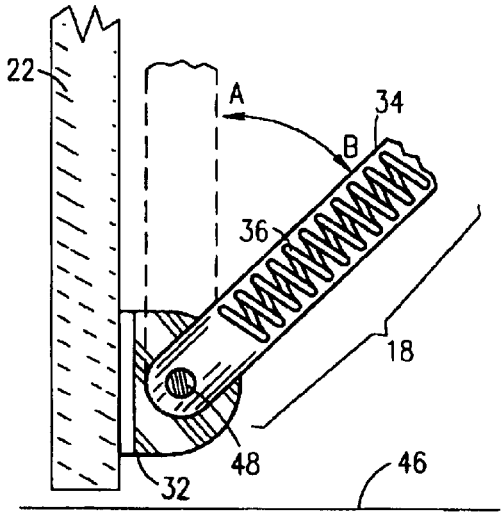
FIG. 5 is a side view of the brace plate and the planar platform.

Referring now to FIG. 5, the brace plate 20 rests flush against the door 22 (affixed by attachment means, such as screws). The brace plate 20 further includes a rod 42 which passes through a pair of apertures 44 in the rear of the planar platform 12 nearest the door 22. The rod 42 works in conjunction with the apertures 44 in allowing the planar platform 12 to move along the lines C-D and D-C for use or storage.

Figure 6:
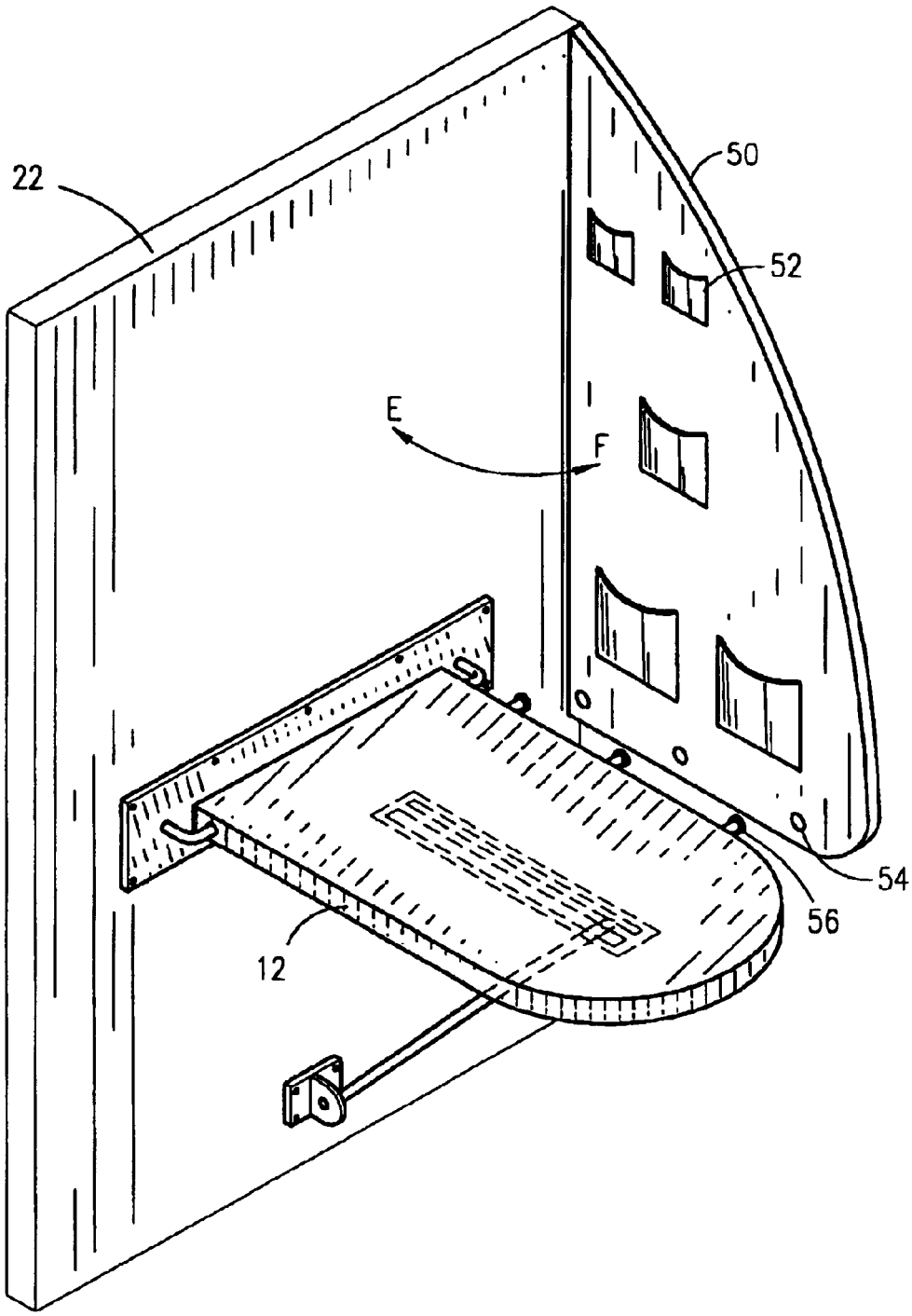
FIG. 6 is a perspective view of an alternative embodiment of the collapsible desk, in which an additional component, a pocket organizer, is included and allows for the storage of desk items.

Referring now to FIG. 6, an alternative embodiment of the collapsible desk 10 is shown in which an additional component, a pocket organizer 50, is included for adding the versatility of storing various desk or household items in the pocketed organizer 50. The pocket organizer 50 has a plurality of pockets 52 and may be a triangular (as shown in FIG. 6) or other geometrically appealing shape. The pocket organizer 50 is fixedly attached to the side of a door 22 by an attachment means, such as a screw, and pivots along the lines E-F and F-E. The pocket organizer 50 further includes a plurality of button snaps 54, or other suitable fasteners, and a matching set of buttons 56, or other suitable fastening projections, so that the pocket organizer 50 may be securely fastened to the side of the planar platform 12. Preferably, the pocket organizer 50 is manufactured from a durable and flexible material, such as nylon, vinyl or other soft plastic material, so as to withstand day-to-day use and maintain the flexibility required for opening and closing the pocket organizer 50 as needed.

2. Operation of the Preferred Embodiment

A user will secure the collapsible desk 10 against a sturdy support structure, such as a door 22, or a wall (not shown) by fixedly attaching the L-shaped brace plate 20 to the body of the door 22, using an attachment means (such as screws). The user will then secure the door plate 32 to the base of the door 22 using an attachment means. If the pocket organizer 50 is included, the user will also attach the pocket organizer 50 to the side of the door 22 by an attachment means.

To use the collapsible desk 10, a user will pull the slidable tongue 30 away from the mid-line of the planar platform 12, allowing the roller 26 to freely move along the track 28. As the roller 26 moves within the track 28, the planar platform 12 will move from a vertical position (or a stored position, shown as "A" in FIG. 4 and "C" in FIG. 5) to a horizontal position (or an open position, shown as "B" in FIG. 4 and "D" in FIG. 5) until the roller 26 abuts the end of the chamber 24. If the pocket organizer 50 is included, the user will simply swing the pocket organizer 50 along a line E-F to expose the pockets 52 for use. The user will then work on the planar platform 12 until work is completed.

The collapsible desk 10 is returned to a vertical position by lowering the planar platform 12, and thus moving the bracing arm 18 toward the "A" position of FIG. 4. When the collapsible desk 10 is vertical, the user will push the slidable tongue 30 toward the mid-line of the planar platform 12 to lock the roller 26 in place and thereby preventing the roller 26 from shifting or otherwise causing damage to the collapsible desk 10 or injury to a nearby person.

The foregoing descriptions of specific embodiments of the present invention have been presented for purposes of illustration and description. They are not intended to be exhaustive or to limit the Invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A collapsible desk comprising:

a planar platform having a top surface and a bottom surface, said bottom surface receiving a spring biased bracing arm;

a brace plate coupled to an end of said planar platform, said brace plate attached to a rigid supporting structure, thereby securing said planar platform to said rigid supporting structure;

a rectangular chamber forming a track in said bottom surface and positioned along a mid-line of said bottom surface extending perpendicularly from said brace place receiving and housing a roller of the spring biased bracing arm; and said spring biased bracing arm fixedly attached to a base plate, said base plate attached to said rigid supporting structure at an elevation inferior to said brace plate, said spring biased bracing arm having said roller at an end opposite said base plate, said roller facilitating expansion and contraction of said bracing arm and placement of said planar platform in a horizontal or vertical position, said roller traveling along said chamber.

2. The desk of claim 1, wherein said track comprises a slidable tongue positioned perpendicular to the direction of said track which may be placed in a closed or open position, wherein in a closed position, said slidable tongue acts to prevent said roller from moving due to the spring biased bracing arm, and further wherein in an open position said slidable tongue allows said roller to move along the track and thereby permitting the planar platform to assume a vertical orientation for storage.

3. The desk of claim 2, wherein a pair of protective bumpers are positioned along said bottom surface so as to provide protection to the rigid supporting structure when said planar platform is lowered into a vertical orientation for storage.

4. The desk of claim 1, wherein said spring biased bracing arm includes a linearly elongated member surrounding an inwardly biased spring.

5. The desk of claim 1, wherein said planar platform further comprises:

a pair of apertures formed in an end adjacent said brace plate;

a rod passing through said pair of apertures;

wherein said rod cooperatively acts in conjunction with said apertures in allowing said planar platform to move between horizontal and vertical positions.

6. The desk of claim 1, further comprising a pocket organizer having a plurality of pockets, said pocket organizer fixedly attached to said rigid support structure and upstanding from a lateral side of side planer via attachment means.

* * * * *